United States Patent [19]

Höll

[11] 4,105,127

[45] Aug. 8, 1978

[54] HOLDER BAR FOR SHEET-LIKE ARTICLES

[75] Inventor: Friedrich Höll, Freigericht, Fed. Rep. of Germany

[73] Assignee: C. Hohage & Cie. KG, Altena, Fed. Rep. of Germany

[21] Appl. No.: 784,596

[22] Filed: Apr. 4, 1977

[30] Foreign Application Priority Data

Apr. 3, 1976 [DE] Fed. Rep. of Germany ... 7610411[U]
Oct. 7, 1976 [DE] Fed. Rep. of Germany ..... 2645169

[51] Int. Cl.[2] ..... B42F 1/00

[52] U.S. Cl. ..... 211/124; 24/67.3; 211/45; 211/89

[58] Field of Search ..... 211/89, 45, 124; 24/81 PC, 67.11, 67.9, 255 R, 67.3

[56] References Cited

U.S. PATENT DOCUMENTS

| | | | |
|---|---|---|---|
| 773,392 | 10/1904 | Holsapple | 24/67.11 |
| 1,165,108 | 12/1915 | Memmler | 211/124 |
| 2,964,197 | 12/1960 | Wallace | 211/45 |
| 3,591,013 | 7/1971 | von Herrmann | 211/89 X |
| 4,010,517 | 3/1977 | Kapstad | 211/89 X |

FOREIGN PATENT DOCUMENTS

| | | | |
|---|---|---|---|
| 1,247,902 | 1971 | United Kingdom | 211/124 |

*Primary Examiner*—Roy D. Frazier
*Assistant Examiner*—Robert W. Gibson, Jr.
*Attorney, Agent, or Firm*—Spencer & Kaye

[57] ABSTRACT

A holder bar for supporting sheet-like articles comprises an outer hollow rod having a throughgoing insertion slot extending along the length dimension of the outer hollow rod and an inner hollow rod arranged within and supported by the outer hollow rod and being coextensive therewith. The inner hollow rod includes resiliently cooperating components to form a clamp aligned with and arranged in the zone of the insertion slot for receiving and resiliently clamping a sheet-like article introduced into the insertion slot.

6 Claims, 2 Drawing Figures

Fig. 1
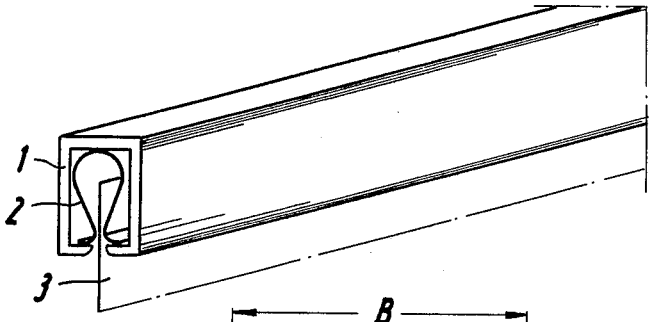
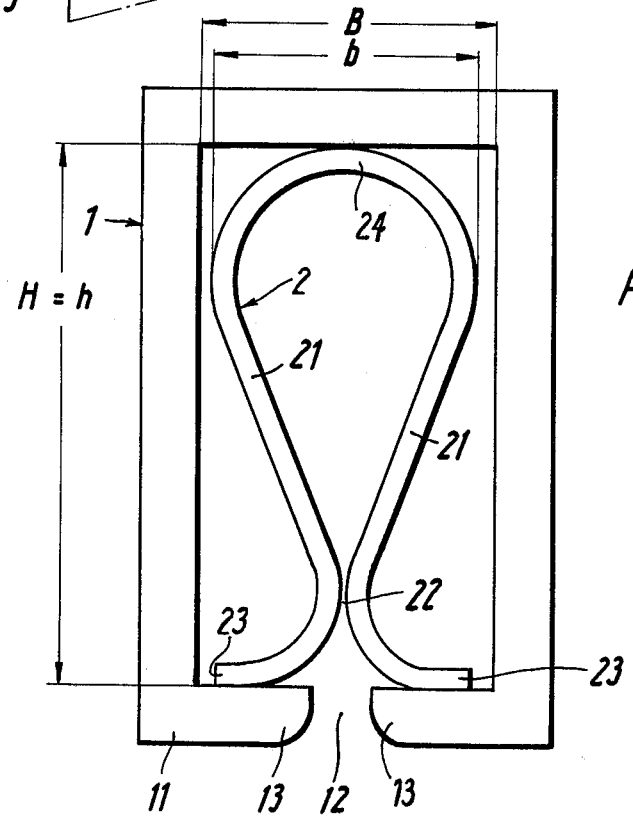
Fig. 2

HOLDER BAR FOR SHEET-LIKE ARTICLES

BACKGROUND OF THE INVENTION

This invention relates to a holding and supporting arrangement for sheet-like articles.

Sheet-like articles such as posters for advertising, informational or educational purposes have a widespread use and are displayed in a great plurality of places such as shop windows, business premises, public buildings and the like. For the purpose of supporting these sheet-like articles in a flat and secure manner — particularly in case they do not have an inherent sufficient stiffness — strip members are secured thereto. The strips are then affixed to a ceiling, a wall, a shelf or the like by means of strings, staples, tubular members or the like. These types of sheet-like articles are relatively frequently replaced; in most cases they are discarded after a single use. This circumstance makes it desirable to provide a strip, rail or bar member to which the sheet-like articles can be replaceably attached.

SUMMARY OF THE INVENTION

It is an object of the invention to provide a holder bar for supporting sheet-like articles which is simple to manufacture and use and which ensures a simple replacement of sheet-like articles supported in a flat and secure manner therein.

This object and others to become apparent as the specification progresses, are accomplished by the invention, according to which, briefly stated, the holder bar for supporting sheet-like articles comprises an outer hollow rod having a throughgoing insertion slot extending along the length dimension of the outer hollow rod and an inner hollow rod arranged within and supported by the outer hollow rod and being coextensive therewith. The inner hollow rod includes resiliently cooperating components to form a clamp aligned with and arranged in the zone of the insertion slot for receiving and resiliently clamping a sheet-like article introduced into the insertion slot.

The holder bar according to the invention is formed of only two hollow, rod-like members which are telescoped into one another and which may be separately manufactured. There are no additional coupling elements between the two rods. The sheet-like article is attached to the holder bar by introducing the article along one edge zone thereof, into the insertion slot of the holder. The latter then securely supports the article by virtue of the resilient clamping effect of the inner hollow rod which is an inherent property thereof; this clamping effect is reinforced by the engagement of the inner rod with the inner side of the outer, housing-like rod, particularly when the leg portions of the clamp-like inner rod are urged away from one another by the inserted sheet-like article.

It is an advantage of the holder bar designed according to the invention that sheet-like articles of different thicknesses may be used therewith. The lower limit for the thickness of the sheet-like article is given if, upon insertion of an article of certain thickness, the free legs of the inner rod are not forced apart so that no reaction can be generated at the outer rod. The upper limit is set by the width of the insertion slot provided in the outer hollow rod. A replacement of the sheet-like article is effected simply by pulling the article out of the insertion slot either transversely to its length dimension or by shifting the article therealong.

The dimensions of the hollow rods are so selected that an insertion of the inner hollow rod into the outer hollow rod during the assembly of the holder bar is possible without the necessity of overcoming any appreciable frictional resistance. Such frictional resistance forces are to be generated in the holder bar according to the invention only at the time when, upon inserting a sheet-like article, the legs of the clamp formed by the inner rod are forces away from one another. The holder bar designed according to the invention may be affixed in a conventional manner to a ceiling, a wall or the like by lugs or similar fasteners.

According to an advantageous feature of the invention the outer rod is of hollow rectangular cross-sectional shape provided, at one narrow side, with a longitudinally extending insertion slot. The inner rod has a generally U-shaped cross section; the legs of the "U" converge to form a receiving slot and are divergent in their terminal portion. This configuration of the inner and outer rod provides a particularly good clamping effect and furthermore results in a smooth housing, constituted by the outer hollow rod.

For facilitating the insertion of the sheet-like articles, the insertion slot is preferably rounded at its outer edges. The insertion, the support and the replacement of the sheet-like articles are coordinated with one another in an optimal manner by providing, according to another feature of the invention, that the greatest width of the inner rod is smaller than the inner width of the outer rod and further, the greatest height of the inner rod is substantially equal to the inner height of the outer rod. With these relationships the inner rod has, within the outer rod, the necessary play for permitting the insertion and the clamping of the sheet-like article.

The rods may expediently be made of a synthetic material.

BRIEF DESCRIPTION OF THE DRAWINGS

FIG. 1 is a perspective view of a preferred embodiment of the invention.

FIG. 2 is an end elevational view of the same embodiment on an enlarged scale.

DESCRIPTION OF THE PREFERRED EMBODIMENT

Turning now to the Figures, the holder bar illustrated therein is formed of an outer hollow rod 1 and an inner hollow rod 2 pushed longitudinally into the outer rod 1, to assume a coextensive relationship therewith.

The outer rod 1 is rectangular in section and has, medially along one narrow side 11, a throughgoing insertion slot 12. The edges 13 defining the insertion slot 12 are externally rounded. The outer rod 1 constitutes the housing of the holder bar.

The inner rod 2 is designed to form an openable clamp in the zone of the insertion slot 12 of the outer rod 1 and is engaged by inner wall portions of the outer rod 1. The clamp is aligned with the insertion slot 12 to receive the sheet-like article upon its introduction into the insertion slot 12. The inner rod 2 has a generally U (or Ω) shape and resilient legs 21. Progressing from the arcuate connecting portion 24 of the legs 21, the latter converge to form a receiving slot 22 and then diverge and extend away from one another at their free ends (feet) 23. The free ends 23 are supported on the inner face of the narrow side 11 of the outer hollow rod 1.

The maximum width *b* of the inner rod 2 is smaller than the inner width B of the outer rod 1, whereas the maximum height *h* of the inner rod 2 is substantially identical to the inner height H of the outer rod 1. By virtue of these relationships the inner rod 2 has, in the direction of its width, the necessary play required for accommodating, by resilient expansion, a sheet-like article 3. Further, these relationships ensure that at the outer rod 1 there is generated the necessary reaction force which aids the resilient clamping effect that is inherently present in the inner rod 2.

The holder bar designed according to the invention may find a great number of applications. In addition for use for holding and supporting posters and the like in shop windows, business premises, public buildings and the like, it may also serve to support and hold drawings, foils, pictures, maps, transparencies and the like. In every instance there is ensured an easy introduction into the insertion slot, a flat, firm holding effect and a simple and easy release by pulling the article either transversely to the length dimension of the holder bar or by sliding it in the longitudinal direction of the holder bar.

It will be understood that the above description of the present invention is susceptible to various modifications, changes and adaptations, and the same are intended to be comprehended within the meaning and range of equivalents of the appended claims.

What is claimed is:

1. A holder bar for supporting sheet-like articles, comprising (a) an outer hollow rod of rectangular cross section formed of opposite wide side walls and opposite narrow side walls; means defining a throughgoing insertion slot along the length dimension of one of the narrow side walls medially thereof; and (b) an inner hollow rod of generally Ω-shaped cross section arranged within said outer hollow rod and being coextensive therewith; said inner hollow rod being formed of two resiliently cooperating legs each terminating in a foot and a connecting portion attaching the two legs to one another remote from the feet; said legs, viewed from said connecting portion, converging towards one another to define an article-receiving portion; said feet being oriented in opposite directions with respect to one another and extending away from said article-receiving portion; said inner hollow rod being supported by said outer hollow rod solely by a contacting relationship between each said foot and the narrow side wall containing said slot and by a contacting relationship between the other narrow side wall and said connecting portion; said article-receiving portion being in alignment with said insertion slot for receiving and resiliently clamping a sheet-like article introduced into said insertion slot.

2. A holder has bar as defined in claim 1, wherein said receiving portion includes a receiving slot defined by said legs.

3. A holder bar as defined in claim 1, wherein the maximum width of said inner hollow rod is smaller than the inner width of said outer hollow rod and the maximum height of said inner hollow rod is substantially equal to the inner height of said outer hollow rod.

4. A holder bar as defined in claim 1, wherein said means defining said throughgoing insertion slot includes two parallel-spaced rounded edges forming part of said one of the narrow side walls.

5. A holder bar as defined in claim 1, wherein said inner and outer hollow rods are made of a synthetic material.

6. A holder bar as defined in claim 1, wherein said feet are spaced from the respective wide side walls of said outer hollow rod in an empty state of said inner hollow rod and wherein said feet are pressed into engagement with said respective wide side walls when the sheet-like article inserted into said inner hollow rod exceeds a predetermined thickness for aiding the resilient clamping effect of said inner hollow rod by a reaction force exerted by said hollow outer rod on said feet.

* * * * *